US005788140A

United States Patent [19]

Scavino et al.

[11] Patent Number: 5,788,140

[45] Date of Patent: Aug. 4, 1998

[54] DEVICE FOR DRIVING INSERTS INTO PIECES OF SHEET METAL

[75] Inventors: Mario Scavino; Stefano Vergano, both of Turin, Italy

[73] Assignee: Amada America, Inc., Buena Park, Calif.

[21] Appl. No.: 613,142

[22] Filed: Mar. 8, 1996

[30] Foreign Application Priority Data

Mar. 10, 1995 [IT] Italy ..... T095A0182

[51] Int. Cl.[6] ..... B21J 15/00

[52] U.S. Cl. ..... 227/119; 227/55; 227/149; 227/152

[58] Field of Search ..... 227/30, 51, 52, 227/53, 55, 57, 61, 62, 107, 108, 112, 119, 124, 139, 140, 149, 152; 29/464, 465

[56] References Cited

U.S. PATENT DOCUMENTS

| | | | |
|---|---|---|---|
| 916,026 | 3/1909 | Sasseman . | |
| 3,042,244 | 7/1962 | Van Hecke . | |
| 3,341,559 | 9/1967 | Reid et al. . | |
| 3,465,410 | 9/1969 | Ernest et al. . | |
| 3,557,597 | 1/1971 | Heslop et al. . | |
| 3,647,129 | 3/1972 | Ehrlich | 227/112 |
| 3,695,086 | 10/1972 | Savage | 227/149 |
| 3,695,499 | 10/1972 | Taylor | 227/52 |
| 3,942,240 | 3/1976 | Gebelius | 227/68 |
| 4,052,788 | 10/1977 | Hastings et al. . | |
| 4,059,980 | 11/1977 | Nance . | |
| 4,596,349 | 6/1986 | Herten | 227/119 |
| 4,628,722 | 12/1986 | Mauer et al. | 227/112 |
| 4,706,868 | 11/1987 | Hammerle et al. | 227/149 |
| 4,709,841 | 12/1987 | Wollar | 227/55 |
| 5,156,314 | 10/1992 | Wallace | 227/107 |
| 5,170,923 | 12/1992 | Dear et al. | 227/55 |
| 5,337,463 | 8/1994 | Rossler et al. . | |

OTHER PUBLICATIONS

*The History of the Auto–Sert Press*, Auto–Sert, Inc., Minneapolis, Minnesota, May 1993.

"Hardware Inserting Press Comparison Notes", Auto–Sert, Inc., Minneapolis, Minnesota, Apr. 1993.

Brochures for Auto–Sert AS 7.5 Press, Auto–Sert, Inc., Minneapolis, Minnesota, date unknown.

Brochure for "Pemserter Series 1000: 8–Ton Automatic Press System", Penn Engineering & Manufacturing Corp., Danboro, Pennsylvania, 1990.

"Self–Clinching Fasterners Improve Assembly Process", Leon M. Attarian, MAN Magazine, Apr. 1994.

Brochure for Haeger 824 Press, Haeger, Inc., Oakdale, California, date unknown.

*Primary Examiner*—Scott A. Smith

*Attorney, Agent, or Firm*—Greenblum & Bernstein P.L.C.

[57] ABSTRACT

A device for driving inserts into pieces of sheet metal includes a punch having a longitudinal axis of symmetry, a thrust surface and a through hole extending along its longitudinal axis which constitutes a supply duct for the inserts. The through hole extends through the thrust surface. A thrust rod applies a driving force to the inserts to move them into position in front of the thrust surface of the punch. The thrust surface drives the head of the insert into a piece of sheet metal through a hole while plastically deforming the periphery of the hole which interfaces with the head.

10 Claims, 6 Drawing Sheets

DEVICE FOR DRIVING INSERTS INTO PIECES OF SHEET METAL

BACKGROUND OF THE INVENTION

1. Field of the Invention

The present disclosure is related to the disclosures provided in the following U.S. applications filed concurrently herewith: "A Machine And A Method For Driving Inserts Into Pieces Of Sheet Metal Device", filed in the names of K. ITO et al. U.S. Ser. No. 08/613,167; and "A Machine And A Method For Driving Inserts Into Pieces Of Sheet Metal", filed in the name of K. ITO U.S. Ser. No 08/613,171; and the disclosures of the aforementioned applications are hereby expressly incorporated by reference herein in their entireties.

The present invention is related to the manufacture of pieces of sheet metal such as casings for electronic devices and the like, furniture elements, etc. More specifically, the present invention relates to the driving of inserts into holes previously formed in the metal sheets.

2. Description of Background Information

Inserts for driving into preformed holes in metal sheets, may be of various shapes and sizes according to the function they are to perform. The most common inserts have holes or shanks, which are generally threaded and form anchorage points for equipment, components and the like.

A press is normally used to drive inserts into the holes in the metal sheets. Generally, the press includes a punch and a die which cooperate with one another. The inserts are anchored to the sheet when they are force-fitted into the respective holes in the sheet so as to bring about plastic deformation of the portion of the metal sheet adjacent the hole in which the insert is inserted. Some existing presses have devices for automatically supplying the insert from a store of inserts to a position in front of a thrust surface of the punch to position the same for insertion.

An automatic supply system is disclosed in U.S. Pat. No. 3,465,410, in which a retractable arm places the inserts on an axis of the punch. The punch includes means for holding an insert in axially alignment on its end. Once the insert is positively held on the end of the punch, the retractable arm withdraws from the operating area of the punch before the driving of the punch is enabled.

The supply system of the device disclosed in U.S. Pat. No. 3,465,410 is slow, owing to the fact that the retractable arm occupies the field of action of the punch, and has to be retracted before the punch can be operated. This solution also requires the insert to be transferred from the arm to the punch, and this action can cause jamming and other forms of malfunctioning.

Another type of insert-driving press with automatic supply has been produced by the company Haeger. In particular, this press, known as HP6-C has a punch associated with a blank holder which is coaxial with and slidable relative to the punch. The blank holder is connected to a pipe through which the inserts are supplied.

It is very complicated to replace the punch or other driving tool of the HPC-6 device, particularly when the replacement has to be carried out automatically. The replacement process requires that the system for supplying the inserts be disconnected from the old tool and then connected to the new tool.

SUMMARY OF THE INVENTION

An object of the present invention is to provide a device for driving inserts comprising a punch for cooperating with an automatic supply system which supplies the inserts into a position in front of the thrust surface of the punch.

Another object is to provide an insert-driving tool which can be rapidly connected to and disconnected from an automatic insert-supply system, and which can work in conjunction with an insert-supply device which does not obstruct the working area.

In particular, the present invention relates to a device comprising a punch with a body having an axis of symmetry and having a hole extending along the axis and constituting the insert-supply duct. The insert-supply duct extends through a surface of the punch which applies the thrust force to the insert in use.

A punch thus formed is particularly suitable for cooperating with sources for supplying inserts of various types.

According to the present invention, these objects are achieved by providing a device for driving inserts into pieces of sheet metal. The device includes a punch having a body extending along a longitudinal axis of symmetry, a thrust surface formed by a distal end of the punch, for applying a driving force to the inserts; and a through hole extending within the body and through the punch along the longitudinal axis for moving the inserts through the punch and placing the inserts in front of the thrust surface. The through hole extends through the thrust surface.

The punch further preferably includes flexible elements extending integrally from the body along the axis of symmetry. The flexible elements include blades which extend from the body towards a distal end of the punch. Each of the blades has a head at a distal end thereof, and the distal ends of the blades form a thrust surface.

The device is further disclosed to include a blank holder coaxial with and coupled slidingly on an external surface of the body of the punch, and resilient means for urging the blank holder toward a distal end of the body such that the blank holder forms an extension of the body. An internal wall of the blank holder cooperates with the heads of the blades so that axial sliding of the blank holder relative to the punch causes the blades to bend towards the axis of symmetry of the punch.

The internal wall of the blank holder is tapered towards the axis of symmetry of the punch in a direction from a proximal end of the punch towards the distal end.

Preferably, the punch further includes a thrust member coaxial with the body. The thrust member is coupled with the body for sliding on an external surface thereof. The blades have external surfaces for cooperating with the thrust member so that sliding of the thrust member relative to the body causes the blades to bend towards the axis of symmetry of the punch.

Each of the heads of the blades preferably includes an abutment element, and the blank holder includes an abutment element which cooperates with the abutment elements of the heads to prevent the blank holder from sliding off the punch. Preferably, each of the heads of the blades includes a portion having two abutment surfaces which are fitted in a cavity in the blank holder to prevent the blank holder from sliding axially relative to the punch.

Sliding of the thrust member relative to the body to cause the blades to bend towards the axis of symmetry, cause a release of the portions of the heads from the cavity in the blank holder, to allow the blank holder to slide axially relative to the punch.

A distal end of the thrust member forms a free surface which contacts one of the two abutment surfaces of each of the heads of the blades during driving of the thrust member to transmit a thrust force from the thrust member to the heads.

The blank holder further preferably includes guide elements for guiding the inserts, and through holes along walls of the blank holder. The guide elements are preferably flat springs which converge through the through holes of the blank holder toward the axis of symmetry of the punch so as to guide the inserts along the axis.

Still further, the device preferably includes a rod which urges the inserts through the through hole in the punch to supply the inserts for insertion.

As will become clear from the following description, the device according to the invention can easily be replaced automatically and does not involve obstructions due to the insert-supply means in the operating area since the inserts come from the rear end of the punch and perform the last portion of the supply travel which places them in front of the thrust surface in a duct formed inside the punch.

The present disclosure relates to subject matter contained in Italian patent application No. T095 A 000182 (filed on Mar. 10, 1995) which is expressly incorporated by reference herein in its entirety.

BRIEF DESCRIPTION OF THE DRAWINGS

Further characteristics and advantages of the present invention will become clear in the course of the detailed description which follows, given purely by way of non-limiting example, with reference to the appended drawings, in which.

DESCRIPTION OF THE PREFERRED EMBODIMENTS

Figure 1:
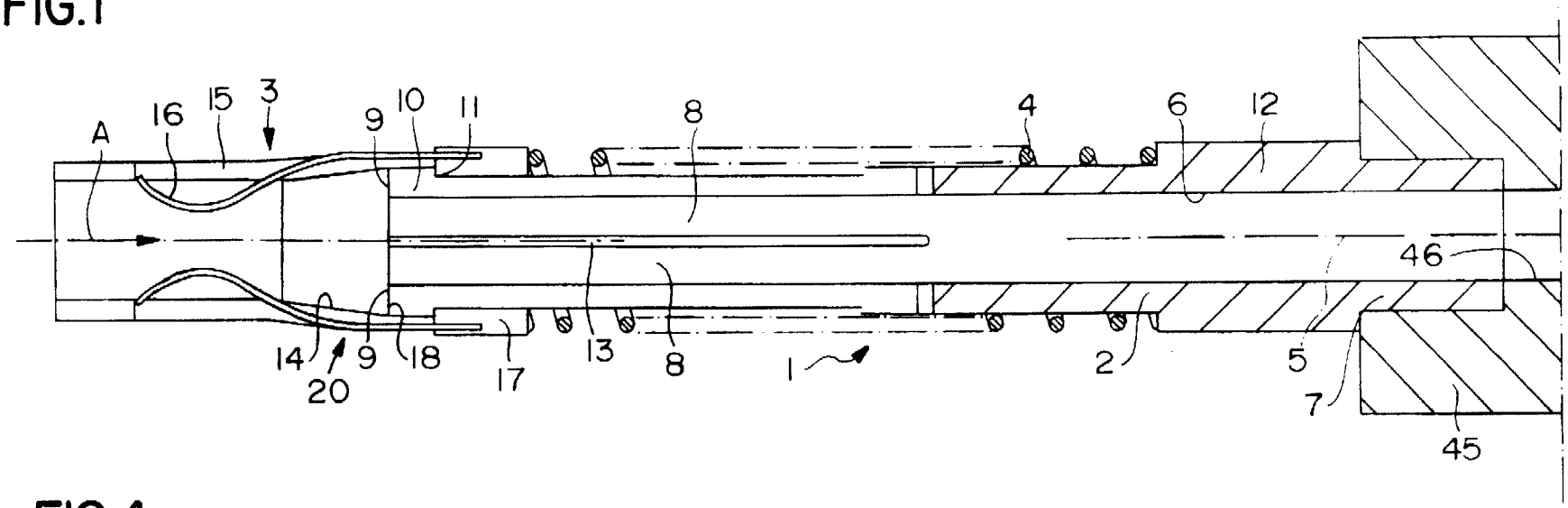
FIG. 1 is a sectional view taken on the longitudinal axis of a punch according to the present invention.

With reference to FIG. 1, a punch includes a body 2 which has a tubular, essentially cylindrical shape, for reasons of structural practicality. The body 2 may, however, be of any shape, for example, polygonal, and is generally elongate along an axis of symmetry 5.

The body 2 includes a through-hole 6, which extends along the axis of symmetry 5, which functions as a supply-duct for the inserts to travel through.

The body further includes an end portion 7 which functions as a shank for connection of the body to an element 45 forming part of a press for driving the inserts. The element 45 includes means for the quick coupling and release of the shank 7. In use, the duct 6 in the punch 1 is aligned with a duct 46 in the element 45 through which the inserts are fed into the duct 6 in the punch 1. The inserts come from automatic loaders (not shown) which guide the inserts to the mouth of the punch in succession. The element 45 of the press is movable along the axis of symmetry 5 of the punch and is connected to an actuator (not shown) which generates the force necessary for driving the inserts.

The body 2 has a plurality of blades 8 which extend parallel to the axis of symmetry 5. The blades 8 are formed by a series of slits 13 through the body 2, only one of which can be seen in FIG. 1. Blades 8 are integral with the rest of the body 2, but can bend resiliently under the action of an external force and return to the undeformed position shown in FIG. 1 when the external force ceases to act. The frontal surfaces of the individual blades 8 define an annular thrust surface 9 which applies the driving force to the inserts. The dimensions of the thrust surface 9 of the punch (particularly its internal diameter) vary as a result of the resilient deformation of the blades 8. As noted above, the supply duct 6 extends the length of the punch 2, and thus through the thrust surface 9.

Heads 10 at the distal ends of the blades 8 define the thrust surface 9 of the punch 1 on one side. The opposite sides of the heads 10 define stop abutments 11, against which the blades 8 are fixed.

A blank holder 3 is configured to slide against the outer surfaces of the blades 8. The blank holder 3 has an internal cavity 14 having a frusto-conical intermediate portion and an end portion which has an internal diameter that is smaller than the outside diameter of the heads 10 of the blades 8 in the undeformed condition. The blank holder 3 further includes windows 15 formed through the walls thereof. Flat springs 16 are anchored to the element 17 and project therefrom. Springs 16 abut the ends of the internal cavity 14 and project into the internal space of the blank holder through windows 15. The springs function to guide the insert and/or restrain it in front of the thrust surface 9.

The element 17 of blank holder 3 is urged against the stop abutments 11 of the blades 8 by a helical compression spring 4 which reacts against an annular shoulder 12 of the body 2. Sliding of the blank holder 3 relative to the body 2 of the punch 1 in the direction indicated by the arrow A in FIG. 1 brings about interference and relative sliding between the internal surface 14 of the blank holder and the heads 10 of the blades 8. This relative sliding forces the heads 10 to follow the contour of the internal surface 14 and thereby deforms the blades 8 toward the axis of symmetry 5. The deformation of the blades 8 causes a reduction in the internal diameter of the opening formed by the thrust surface 9.

FIGS. 2*a*–2*c* and 3*a*–3*c* show various steps in the driving of an insert. A piece of sheet metal 30 includes a hole 31 into which an insert is to be driven. A die 20 includes a locating pin 21 which is slidable through hole 22. Locating pin 21 is resiliently biased outwardly from the hole 22 by a helical compression spring 23.

Figure 2A:
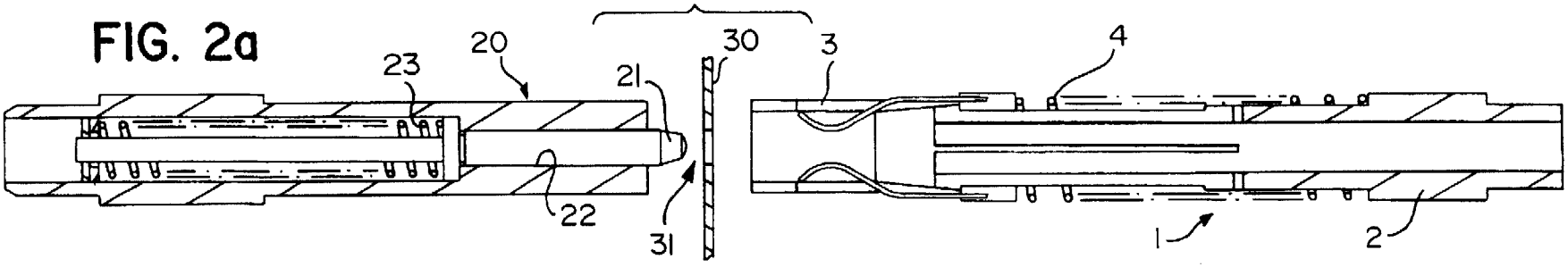
FIGS. 2*a*–2*c* are sectional views of the device according to the invention during an approach, a centering of a hole in, and a clamping of a piece of sheet metal.

In FIG. 2*a*, the sheet 30 is first roughly positioned in the assembly between the punch 1 and the die 20, with the hole 31 in the general vicinity of the axis of symmetry 5. Unlike in conventional presses, the piece of sheet metal 30 is suspended in a vertical plane whereas the punch and the die are aligned along a horizontal axis. Vertical suspension of the sheet metal piece prevents problems connected with deformations caused by gravitational effects on a sheet that are apt to occur when a sheet is held horizontally, particularly when the sheet lacks stiffening bends. The axis of the hole 31 in the piece of sheet metal 30 is then aligned with the axis 5 of the punch using the locating pin 21, which is also aligned along the same axis.

Figure 2B:
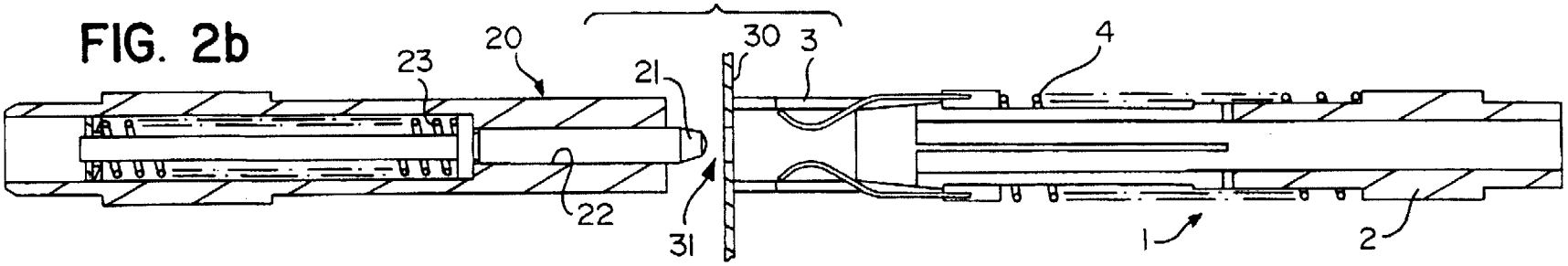
Figure 2C:
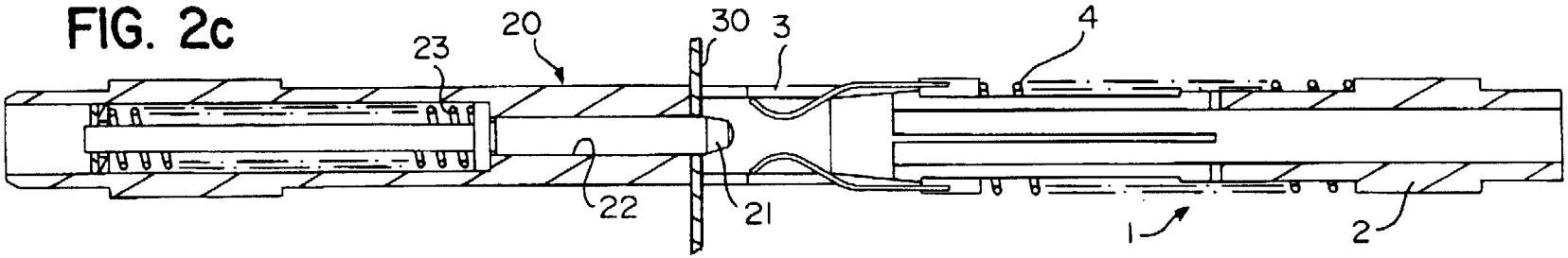

In FIG. 2*b*, the punch 1 is moved towards the sheet metal piece 30 until the blank holder 3 makes contact with the surface of the sheet 30. In FIG. 2*c*, the die 20 is moved towards the sheet metal piece 30 until the end of the die 20 makes contact with the sheet 30. During this movement, the locating pin 21 inserted through the hole 31, thereby finely adjusts the alignment of the components. This step completes the gripping of the sheet between the punch and the die. At this time, the sheet is securely clamped between the distal end of the die 20 and the distal end of the blank holder 3.

Figure 3A:
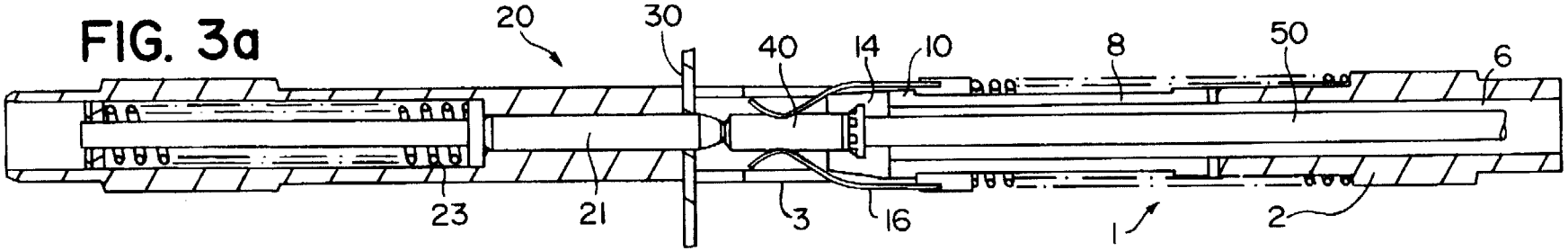
FIGS. 3*a*–3*c* show the device of FIG. 1 during a supply, insertion and driving of an insert.

Next, as shown in FIG. 3*a*, a thrust rod 50 is driven by an actuator (not shown) included in the press, to advance an insert 40 through the duct 6, to position the insert 40 in front of the thrust surface 9. As shown in FIG. 3*a*, the insert 40 is advanced to a position where it is restrained between the thrust rod 50 and the locating pin 21. At this position, the insert 40 is also laterally guided by the flat springs 16 of the blank holder 3.

Figure 3B:
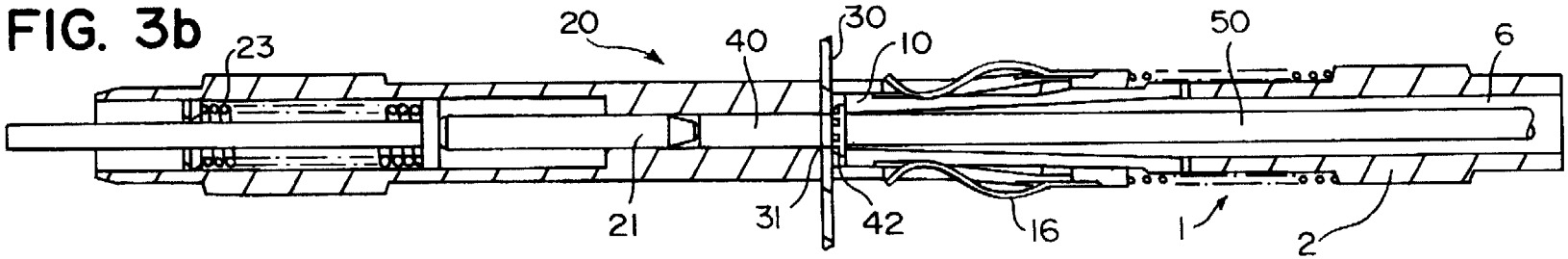

The thrust rod 50 continues to advance the insert, as shown in FIG. 3*b*, and drives a shank portion of the insert 40 through the hole 31. At the same time, the punch 1 starts to advance towards the die 20. The advancement of the punch causes the heads 10 of the blades 8 to slide relative to the frusto-conical portion 14 of the blank holder 3. Thus, the heads 10 are pushed towards the axis of symmetry 5 by the frusto-conical portion 14 of the blank holder 3, as described above causing deformation of the blades 8. As the heads 10 are pushed towards the axis of symmetry 5, the inside diameter of the thrust surface 9 reduces until it becomes smaller than an outside diameter of the head 42 of the insert 40. Thus, the thrust surface 9 forms a bearing surface for the head 42.

The punch 1 is further advanced to generate a driving force which is transmitted to the insert 40 by means of the blades 8 and the thrust surface 9. This driving force causes plastic deformation of the region of the sheet in the immediate vicinity of the hole 31, as the head of the insert is driven into the sheet.

Figure 3C:
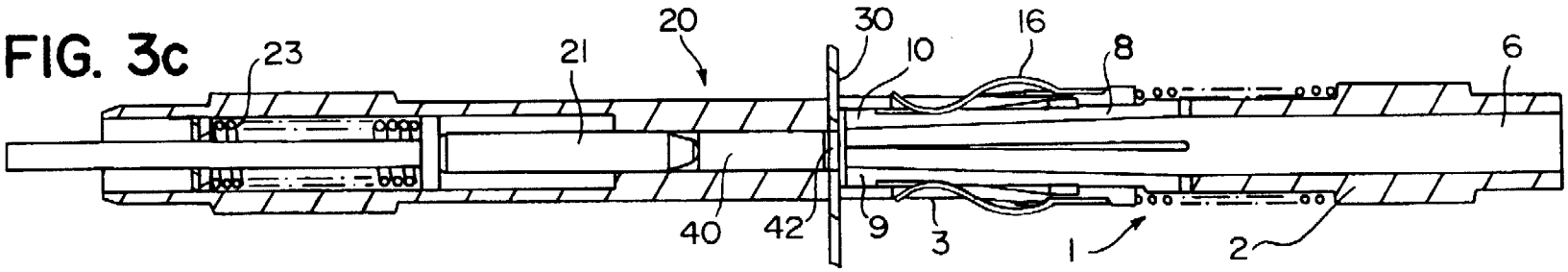

FIG. 3*c* shows the configuration of the device upon completion of the driving of the insert. The punch 1 is next brought back to its starting position, thereby allowing the spring 4 to return the blank holder 3 to the distal end of the punch 1, as the spring 4 returns to its least compressed position. When the blank holder has reached its starting position (i.e., at the distal end of the punch 1), the heads 10 of the blades 8 disengage from the frusto-conical surface, thereby allowing the blades 8 to return to their original, undeformed positions as shown in FIG. 1. Thus, the unrestricted, opening of the duct 6 is reestablished to permit the passage of a new insert therethrough.

Figure 4:
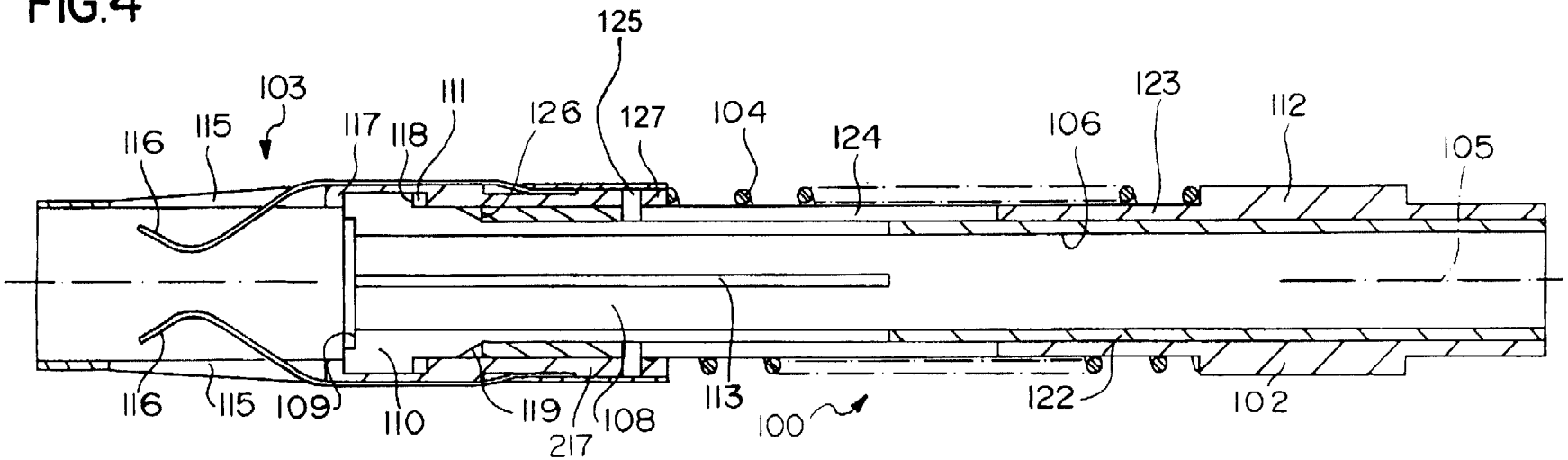
FIG. 4 is a sectional view of an alternative embodiment of a punch according to the present invention.

FIG. 4 shows an alternative embodiment of the punch according to the present invention. The punch 100 includes a blank holder 103 which cooperates with a spring 104, in the same manner that the above-described blank holder 3 cooperates with spring 4. The punch 100 includes an insert-supply duct 106, which corresponds to the supply duct 6 of the first embodiment.

The body 102 of the punch 100 includes a tubular member 122 in which the blades 108 are formed, and a thrust member 123 mounted for sliding coaxially on the outer surface of the tubular member 122. The flexible blades 108 are formed by slits 113 made in the wall of the tubular member 122. The distal ends of the blades 108 include heads 110 which form the thrust surface 109, and which are fitted in an annular cavity 111 of the blank holder 103. The heads 110 further include abutment surfaces 117 and 118, which abut against opposite walls of the annular cavity 111.

The heads further include inclined surfaces 119. The thrust member 123 is axially movable such that the distal end 126 thereof contacts the inclined surfaces 119 and slides with respect thereto. The walls of the thrust member are relatively unyielding and thus cause the blades 108 to bend towards the axis 105 of the device upon sliding movement of the distal end along the inclined surfaces 119. As the thrust member advances, the blades 108 are bent sufficiently to release the heads 110 from the annular cavity 111. The distal end 123 slides along the inclined surfaces until it contacts the abutment surfaces 118 so as to transmit the thrust force thereof to the thrust surface 109.

The spring 104 is located between an abutment element 127 of the blank holder 103 and an annular shoulder 112 formed on the thrust element 123. The thrust element 123 further includes an oblong groove 124 in which pins 125, fixed to the blank holder 103, are engaged. As in the previous embodiment, the blank holder 103 has windows 115 through which flat springs 116 extend. Springs are fixed to the abutment element 217 and function to laterally guide and restrain the inserts.

Figure 5A:
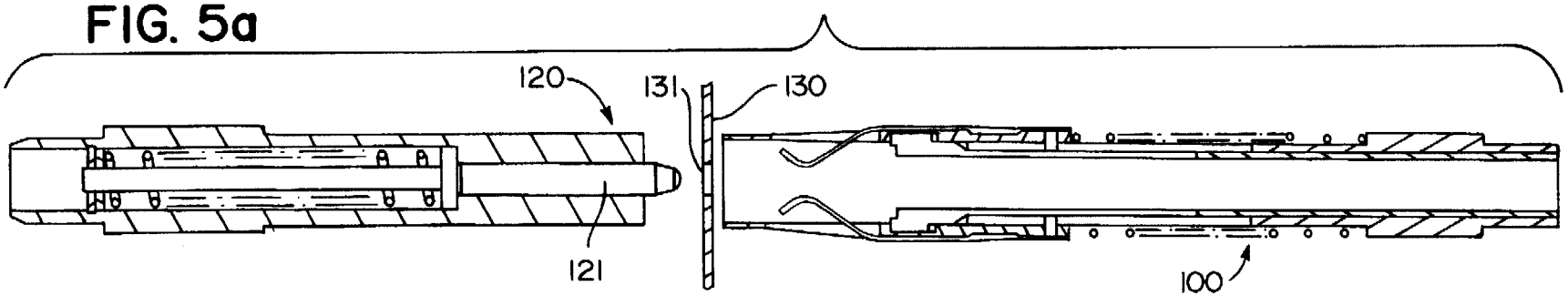
FIGS. 5*a*–5*c* are sectional views of an approach, a centering of a hole and a clamping of a piece of sheet metal using the device shown in FIG. 4.

FIGS. 5*a*–5*c*, 6*a*, 6*b* and 7*a*–7*c* show the operating sequence of the embodiment shown in FIG. 4. In FIG. 5*a*, the sheet 130 is first roughly positioned in the assembly between the punch 100 and the die 120, with the hole 131 in the general vicinity of the axis of symmetry 105. Unlike in conventional presses, the piece of sheet metal 130 is suspended in a vertical plane whereas the punch and the die are aligned along a horizontal axis. The axis of the hole 131 in the piece of sheet metal 130 is then aligned with the axis 105 of the punch and the locating pin 121 is also aligned along the same axis.

Figure 5B:
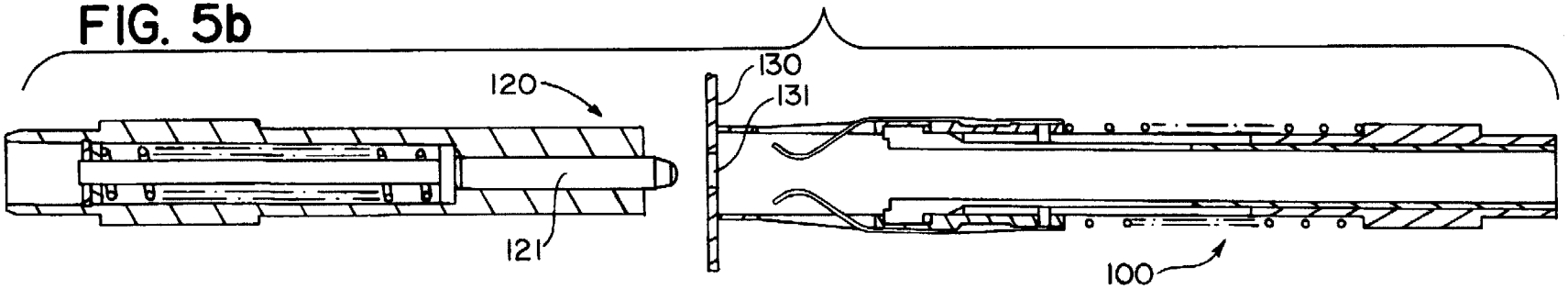
Figure 5C:
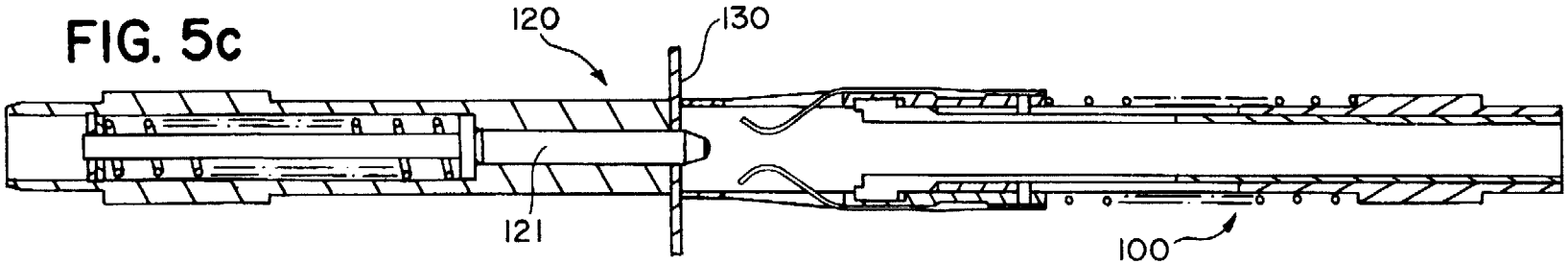

In FIG. 5*b*, the punch 100 is moved towards the sheet metal piece 130 until the blank holder makes contact with the surface of the sheet 130. In FIG. 5*c*, the die 120 is moved towards the sheet metal piece 130 until the end of the die 120 makes contact with the sheet 130. During this movement, the locating pin 121 inserted through the hole 131, thereby finely adjusts the alignment of the components. This step completes the gripping of sheet between the punch and the die. At this time, the sheet is securely clamped between the distal end of the die 120 and the distal end of the blank holder. In the next step shown in FIG. 6*a*, a thrust rod 150 is driven by an actuator (not shown) included in the press, to advance an insert 140 through the duct 106, to urge the shaft of the insert 140 through the hole 131, at the same time forcing the retraction of the locating pin 121 from the hole 131.

Figure 6A:
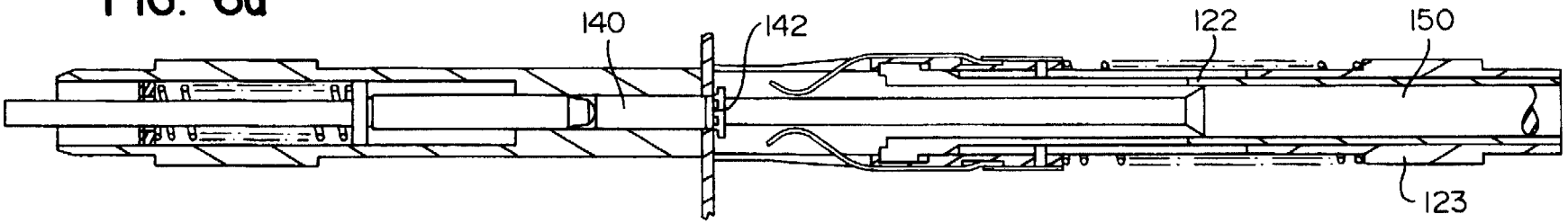
FIGS. 6*a* and 6*b* show a supply and insertion of an insert and an initial stage of the advance of the thrust element using the device shown in FIG. 4.
Figure 6B:
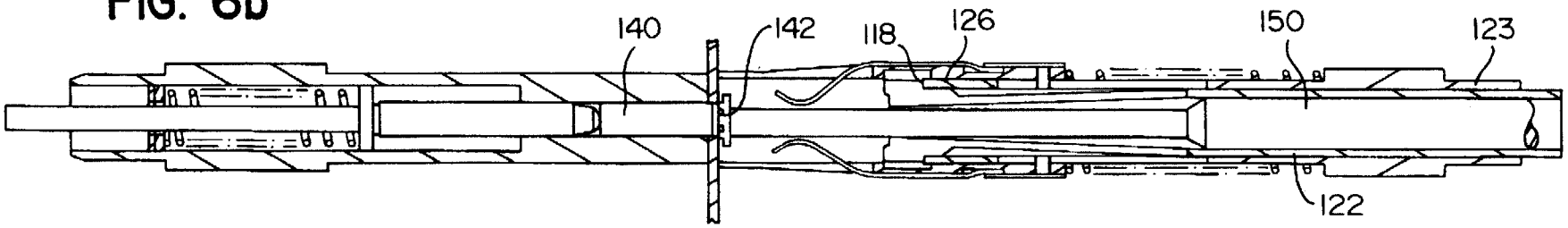

Next, as shown in FIG. 6*b*, the thrust member 123 is advanced, so that the distal end 126 slides against the inclined surfaces 119 of the heads 110 and causes bending of the blades 108 and the reduction in the inner diameter of the thrust surface 109. As the thrust member 123 advances still further, the distal end 126 slides off the inclined surfaces 119 and comes into contact with the abutment surface 118 of the heads 110. Accordingly, the thrust member 123 entrains the tubular member 122, and drives the tubular member, through the contact between the distal end 126 and abutment surfaces 118, towards the head 142 of the insert 140.

Figure 7A:
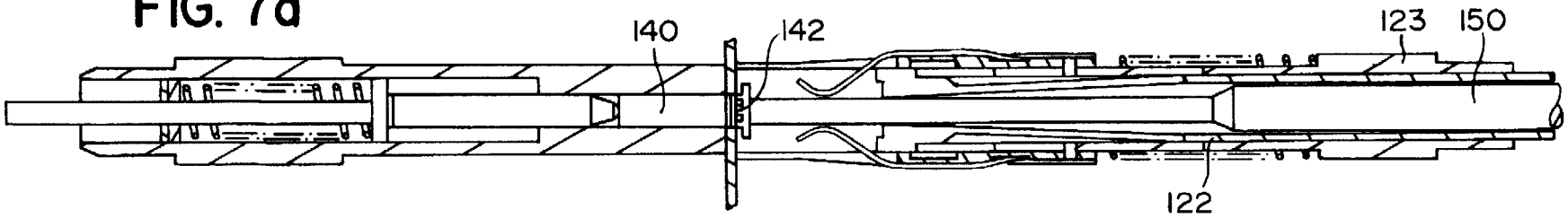
FIGS. 7*a*–7*c* show various stages of advance of the thrust element of the punch using the device shown in FIG. 4.
Figure 7B:
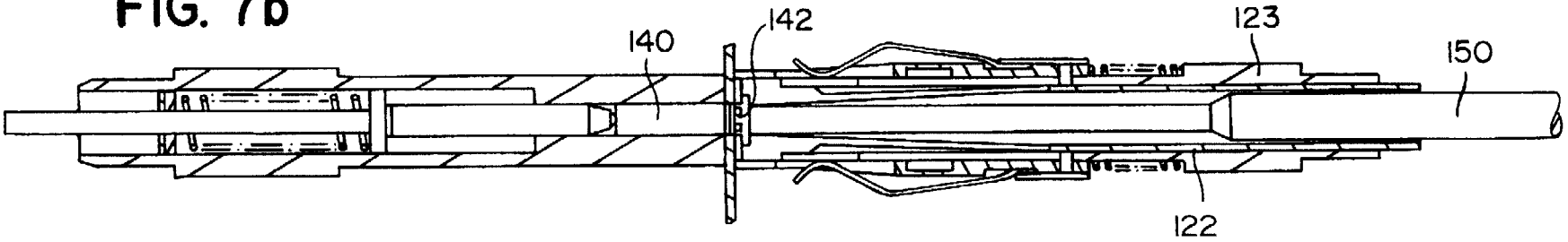

FIGS. 7*a* and 7*b* show that upon placement of the shank 140 of the insert through the hole 131, the tubular member 122 is advanced towards the die 120. The advancement of the tubular member 122 continues so that thrust surfaces 109 make contact with the head 142 of the insert as shown in FIG. 7*b*. Continued driving of the tubular member 122 and thus the thrust surfaces against the head 142 causes plastic deformation of the region of the sheet in the immediate vicinity of the hole 131, as the head 142 of the insert is driven into the sheet, and the movement of the tubular member is discontinued when abutment surfaces 117 make contact with the sheet 130.

Figure 7C:
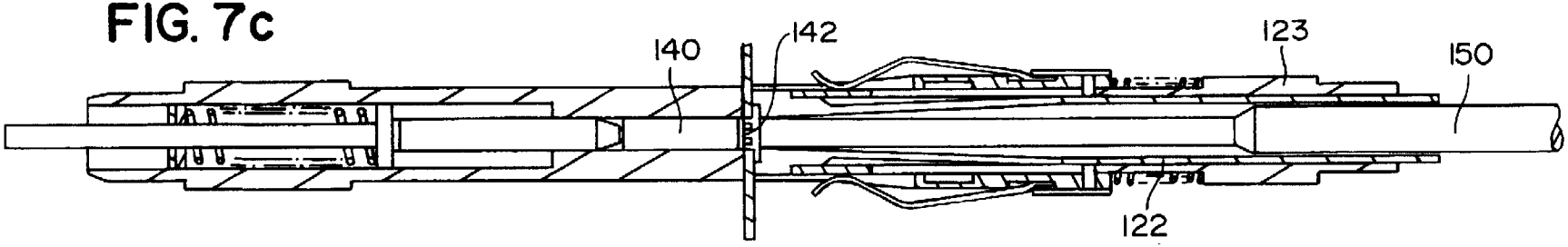

FIG. 7*c* shows the configuration of the device upon completion of the driving of the insert. After completion of the driving operation, the thrust member 123 is retracted. At the same time, an actuator, not shown, urges the tubular member 122 towards the distal end of the thrust member 123. The heads 110 of the blades 108 thus return to their original positions inside the cavity 111 of the blank holder 103 and the device is ready for a new cycle.

The second embodiment of the punch is particularly advantageous owing to the fact that it avoids axial compression stresses on the blades 108.

Although the invention has been described with reference to particular means, materials and embodiments, it is to be understood that the invention is not limited to the particulars disclosed and extends to all equivalents within the scope of the claims.

What is claimed:

1. A device for driving inserts into pieces of sheet metal, comprising:

a punch having a body extending along a longitudinal axis of symmetry;

a thrust surface formed by a distal end of said punch, for applying a driving force to the inserts; and a through hole extending within said body and through said punch along said longitudinal axis for moving the inserts through said punch and placing the inserts in front of said thrust surface;

wherein said through hole extends through said thrust surface;

flexible elements extending integrally from said body along said axis of symmetry, said flexible elements including blades which extend from said body towards a distal end of said punch, each of said blades including a head at a distal end thereof, said distal ends of said blades forming the thrust surface;

a blank holder coaxial with and coupled slidingly on an external surface of said body, said blank holder including an internal wall for cooperating with said heads of said blades so that axial sliding of said blank holder relative to said punch causes said blades to bend towards said axis of symmetry of said punch, said internal wall of said blank holder being tapered towards said axis of symmetry of said punch in a direction from a proximal end of said punch towards said distal end.

2. A device according to claim 1, further comprising:

resilient means for urging said blank holder toward a distal end of said body such that said blank holder forms an extension of said body.

3. A device according to claim 2, wherein said blank holder comprises guide elements for guiding the inserts.

4. A device according to claim 3, wherein said blank holder further comprises through holes along walls of said blank holder; and wherein said guide elements comprise flat springs which converge through said through holes of said blank holder toward said axis of symmetry of said punch so as to guide the inserts along said axis.

5. A device according to claim 1, wherein each of said heads of said blades comprises an abutment element;

wherein said blank holder comprises an abutment element; and wherein said abutment elements of said head and said abutment element of said blank holder cooperate to prevent said blank holder from sliding off said punch.

6. A device according to claim 1, further comprising:

a rod which urges the inserts through said through hole in said punch to supply the inserts for insertion.

7. A device for driving inserts into pieces of sheet metal, comprising:

a punch having a body extending along a longitudinal axis of symmetry;

a thrust surface formed by a distal end of said punch, for applying a driving force to the inserts; and a through hole extending within said body and through said punch along said longitudinal axis for moving the inserts through said punch and placing the inserts in front of said thrust surface;

wherein said through hole extends through said thrust surface;

flexible elements extending integrally from said body along said axis of symmetry, said flexible elements including blades which extend from said body towards a distal end of said punch, each of said blades including a head at a distal end thereof, said distal ends of said blades forming said thrust surface;

said punch including a thrust member coaxial with said body, wherein said thrust member is coupled with said body for sliding on an external surface of said body, and wherein said blades have external surfaces for cooperating with said thrust member so that sliding of said thrust member relative to said body causes said blades to bend towards said axis of symmetry of said punch.

8. A device according to claim 7, wherein each of said heads of said blades comprises a portion having two abutment surfaces which are fitted in a cavity in said thrust member to prevent said thrust member from sliding axially relative to said punch.

9. A device according to claim 8, wherein said sliding of said thrust member relative to said body to cause said blades to bend towards said axis of symmetry, releases said portions of said heads from said cavity in said thrust member, to allow said thrust member to slide axially relative to said punch.

10. A device according to claim 8, wherein a distal end of said thrust member comprises a free surface which contacts one of said two abutment surfaces of each of said heads of said blades during driving of said thrust member to transmit a thrust force from said thrust member to said heads.

* * * * *